United States Patent [19]

Morrow et al.

[11] 3,978,602

[45] Sept. 7, 1976

[54] SHELL DEFLECTOR-CATCHER

[75] Inventors: Edward Lucas Morrow, Fairfield; Peter Edward Colatosti, Hamden, both of Conn.

[73] Assignee: Olin Corporation, New Haven, Conn.

[22] Filed: Oct. 14, 1975

[21] Appl. No.: 622,192

[52] U.S. Cl. ..... 42/1 T

[51] Int. Cl.[2] ..... F41C 27/00

[58] Field of Search ..... 42/1 T

[56] References Cited

UNITED STATES PATENTS

| | | | |
|---|---|---|---|
| 3,609,900 | 10/1971 | Bernocco, Jr. | 42/1 T |
| 3,755,946 | 9/1973 | Tomlinson et al. | 42/1 T |
| 3,881,268 | 5/1975 | Petersen | 42/1 T |
| 3,893,253 | 7/1975 | Weatherby et al. | 42/1 T |

*Primary Examiner*—Charles T. Jordan

*Attorney, Agent, or Firm*—Donald R. Motsko; William W. Jones

[57] ABSTRACT

A shell deflector-catcher which can be removably mounted on the receiver of a firearm adjacent to the shell ejection port therein. The device is provided with tabs which engage walls of the receiver and a springy finger which lies adjacent to the ejection port and contacts spent shells ejected therefrom to deflect the shells downwardly toward the ground. The spring finger may be fitted with a removable cap which enlarges the dimensions of the finger to enable it to cooperate with one side wall of the ejection port to catch ejected shells and prevent them from falling to the ground.

7 Claims, 5 Drawing Figures

SHELL DEFLECTOR-CATCHER

This invention relates to an improved device in the form of a clip which can be removably mounted on the receiver of a firearm to deflect spent shells ejected through an ejection port in the firearm receiver. The device can also be easily modified to serve as a shell catcher which prevents ejected shells from falling to the ground.

A number of different devices have been proposed and disclosed in the prior art for catching or deflecting spent shells ejected from the receiver of a firearm. These devices may be attached to the receiver or to the bolt, and specific ones thereof are disclosed in U.S. Pat. Nos. 3,087,387; 3,270,617; 3,390,610; 3,603,015; 3,609,900; 3,733,728; 3,755,946; 3,807,075; 3,881,268; and 3,893,253.

There are several drawbacks attendant to the prior art devices referred to above, namely, those designed to be attached to the bolt of the firearm generally require undesirable modification of the bolt to accept and retain the device, and those attached to the receiver are generally free to be accidently displaced away from their operating positions adjacent to the ejection port of the receiver. Furthermore, the prior art shell deflectors cannot be readily adapted to perform the shell catching function and visa versa.

The device of this invention overcomes these drawbacks by being removably attached to the firearm receiver in such a way as to be secured against accidental displacement in all directions through positive engagement with several areas of the receiver and other static parts of the firearm. The device is also readily changed from a shell deflector to a shell catcher, and back again manually. The device is of simple construction and can be formed from a flat blank sheet of spring steel. The device is light weight and lies close to the firearm receiver when mounted so as not to distract the shooter or upset firearm balance.

It is, therefore, an object of this invention to provide a device for removable affixation to a firearm receiver which device engages an ejected spent shell casing as the latter passes through the receiver ejection port.

It is yet another object of this invention to provide a device of the character described which can be easily adapted to serve as a shell catcher which stops complete ejection of spent shells so that they can be manually removed by the shooter.

It is an additional object of this invention to provide a device of the character described which is light weight, unobtrusive when mounted on the firearm, and readily mass produced.

These and other objects and advantages of the invention will become more readily apparent from the following detailed description of a preferred embodiment of the invention taken in conjunction with the accompanying drawings, in which.

Figure 1:
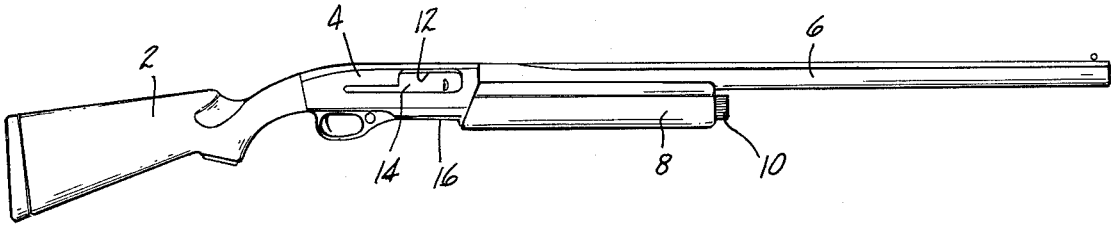
FIG. 1 is a side elevational view of a semi-automatic shotgun with which the device of this invention may be used.

Referring now to FIG. 1 there is shown a semi-automatic shotgun with which the device of this invention may be used. The gun includes a buttstock 2, a receiver 4, a barrel 6, and a forearm stock 8. The ammunition magazine is disposed inside of the forearm 8 below the barrel 6 in a conventional manner. The gun may be taken down by loosening a threaded cap 10 screwed onto the forward end of the magazine and gas cylinder and sliding the forearm 8 away from the receiver. It will be understood that, when fully assembled, the forearm 8 overlies a portion of the front end of the receiver 4. The receiver 4 is provided with a side ejection port 12 and carries a reciprocating bolt 14. A bottom ammunition loading port 16 is also disposed on the receiver.

Figure 2:
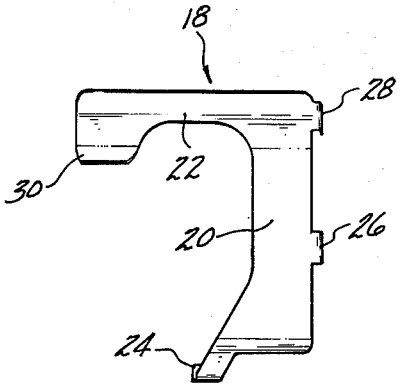
FIG. 2 is a side elevational view of a device formed in accordance with this invention.
Figure 3:
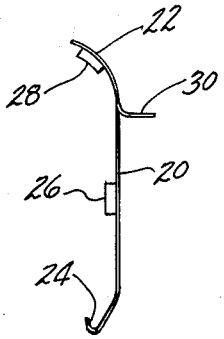
FIG. 3 is an end elevational view of the device of FIG. 2 taken from the left-hand side thereof.

FIGS. 2 and 3 illustrate a preferred embodiment of the shell deflector-catcher of this invention. The device is formed from a flat blank of spring steel of proper outline which is formed to the configuration shown which closely hugs the outside surface of the firearm receiver on which the device is mounted. The device, denoted generally by the numeral 18, includes a pair of legs 20 and 22 which are generally perpendicular to each other. For convenience the leg 20 can be termed the vertical leg, and the leg 22 can be termed the horizontal leg. The lower extremity of the vertical leg 20 is formed with an inwardly tapered and upwardly extending hook element 24 and the forward end wall of the vertical leg 20 is formed with a pair of inwardly bent tabs 26 and 28. The rearward end of the lower edge of the horizontal leg 22 has formed thereon a downwardly and outwardly depending finger 30.

Figure 4:
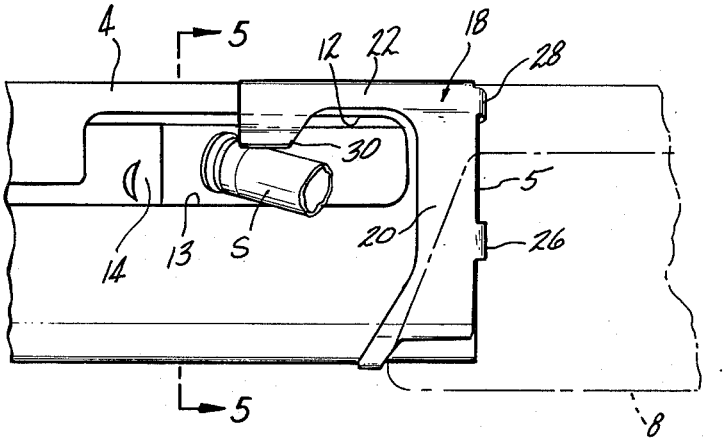
FIG. 4 is a fragmented enlarged side elevational view of the receiver portion of the gun of FIG. 1 showing the device of FIG. 2 mounted thereon with a part of the view being shown in phantom for purposes of clarity.
Figure 5:
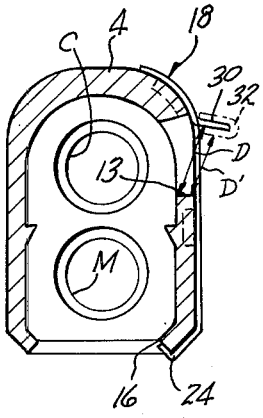
FIG. 5 is a sectional view taken along line 5—5 of FIG. 4.

FIGS. 4 and 5 show how the shell deflector-catcher 18 is mounted on the firearm receiver 4 and how it operates. The bolt assembly 14 is shown in FIG. 4 in its retracted position and a spent shell S is shown being ejected through the ejection port 12. The device 18 is mounted on the receiver 4 with the vertical leg 20 overlying the forward part of the receiver 4. The hook 24 engages the side wall of the loading port 16 and the tabs 26 and 28 engage the front wall 5 of the receiver 4. The hook 24 thus prevents the device 18 from moving up and outwardly away from the receiver 4 and the tabs 26 and 28 prevent the device 18 from moving rearwardly on the receiver 4. It will be noted that the forearm 8 (shown in phantom in FIG. 4) overlies a portion of the device 18 and thus holds the latter against outward and downward movement with respect to the receiver 4. The device 18 is mounted as shown by unscrewing the cap 10 somewhat and sliding the forearm 8 forward over the magazine enough to expose the front edge 5 of the receiver 4. After the device 18 is properly positioned, the forearm 8 is slid back into proper position and the cap 10 is retightened.

It will be noted that the vertical leg 20 is offset forwardly from the ejection port 12 and that the horizontal leg 22 extends backward over the top corner of the receiver 4 above the ejection port 12. The finger 30 extends downwardly and outwardly over the ejection port 12 in such a manner that the shell S being ejected laterally out through the ejection port 12 will strike the finger 30 and be deflected straight down thereby to the ground. The distance D shown in FIG. 5 between the lower edge 13 of the ejection port 12 and the finger 30 is large enough to permit full ejection of the shell S through the ejection port 12. In this manner the device 18 serves as a shell deflector.

To convert the device 18 to a shell catcher, a cap 32 (shown in phantom in FIG. 5) is frictionally fitted onto the finger 30. The cap 32 may be made of rubber, plastic, metal, or the like and is sized so as to be manually mountable onto and demountable from the finger 30, and yet will remain in place on the finger 30 by friction against accidental displacement therefrom. The cap 32 is of sufficient thickness to reduce the distance D between the finger 30 and lower edge 13 of the ejection port 12 to D'. The distance D' is sized so as to permit passage of the tube part of a shell 3 but prevent passage of the rim part of the head of the shell. Thus the shell will be partially ejected through the port 12 with the extracting rim being held between the lower edge 13 of the ejection port 12 and the exterior of the cap 32. Complete removal of the shell can then be accomplished manually by reason of the springy nature of the finger 30. It will be noted that C represents the firing chamber mouth and M the magazine mouth in FIG. 5.

It will be readily appreciated that the device of this invention can be easily converted from a shell deflector to a shell catcher and back again, and thus serves a dual function. The device is inexpensive and simple to manufacture, being formed from a one-piece blank of spring steel. It fits securely on the receiver of the gun and is held thereon against accidental displacement in all directions. It also fits closely against the exterior surface of the receiver so as not to provide a distraction for the shooter.

Since many changes in the disclosed embodiment of the invention may be made without departing from the inventive concept, it is not intended to limit the invention otherwise than as required by the appended claims.

What is claimed is:

1. A device adapted to be removably mounted on a receiver of a firearm to deflect or catch a spent shell casing ejected through an ejection port on the firearm, said device comprising:

a. a pair of legs extending substantially perpendicularly to each other and contoured to fit closely to the side of the firearm receiver;

b. hook means formed at one end of one of said legs for engagement with a side wall of a loading port on the firearm receiver;

c. tab means formed on one edge of said one of said legs and bent at substantially right angles to said one of said legs to engage a front wall of the receiver; and d. finger means formed at an end of the other of said legs and depending therefrom to a location outwardly offset from the ejection port to engage a spent shell ejected therefrom.

2. The device of claim 1, further comprising cap means removably mounted on said finger means to increase the thickness thereof.

3. A device adapted to be removably mounted on a firearm receiver to deflect or catch a spent shell casing ejected through an ejection port on the firearm, said device comprising:

a. a body of sheet spring steel contoured to fit closely over the side of the firearm receiver, said body having a first edge adapted to lie adjacent to the side wall of a loading port in the receiver, a second edge adapted to lie adjacent to a front wall of the receiver, and a third edge adapted to lie adjacent to a top wall of the ejection port;

b. hook means formed on said first edge of said body to engage the side wall of the loading port to prevent said body from moving upwardly and outwardly away from the firearm receiver;

c. tab means formed on said second edge of said body and extending at right angles therefrom to engage the front wall of the receiver to prevent said body from moving rearwardly away from the firearm receiver; and d. finger means depending downwardly and outwardly from said third edge to provide a surface which contacts an ejected shell casing passing through the ejection port.

4. The device of claim 3, further comprising cap means removably fitted onto said finger means to increase the thickness thereof providing means for cooperating with a lower wall of the ejection port to engage and retain a spent shell ejected through the ejection port.

5. In combination with a firearm having a receiver, a loading port, an ejection port, and a forearm stock, a shell deflecting or catching device comprising:

a. a body of sheet spring steel contoured to fit closely over an outside surface of said receiver;

b. hook means formed on one edge of said body in hooking engagement with a side wall of said loading port to hold said body against upward and outward movement with respect to said receiver;

c. tab means formed on another edge of said body and extending perpendicularly thereto into engagement with a front wall of said receiver to hold said body against rearward movement with respect to said receiver; and d. finger means formed on said body and extending downwardly and outwardly adjacent to said ejection port to engage a spent shell ejected through said ejection port.

6. The combination of claim 5, wherein said forearm stock overlies a portion of said body to prevent the latter from moving outwardly and downwardly away from said receiver.

7. The combination of claim 5, further providing cap means removably mounted on said finger means to increase the thickness thereof and provide means cooperating with a wall of said ejection port to catch a shell ejected through said ejection port and prevent the ejected shell from falling free of the firearm.

* * * * *